US006225880B1

(12) United States Patent
Kern

(10) Patent No.: US 6,225,880 B1
(45) Date of Patent: May 1, 2001

(54) ELECTROMAGNETIC RELAY

(75) Inventor: Josef Kern, Berlin (DE)

(73) Assignee: Tyco Electronics Corp, Wilmington, DE (US)

( * ) Notice: Subject to any disclaimer, the term of this patent is extended or adjusted under 35 U.S.C. 154(b) by 0 days.

(21) Appl. No.: 09/529,892

(22) PCT Filed: Aug. 28, 1998

(86) PCT No.: PCT/DE98/02544

§ 371 Date: Apr. 19, 2000

§ 102(e) Date: Apr. 19, 2000

(87) PCT Pub. No.: WO99/22393

PCT Pub. Date: May 6, 1999

(30) Foreign Application Priority Data

Oct. 24, 1997 (DE) ..... 197 47 167

(51) Int. Cl.[7] ..... H01H 51/22; H01H 9/00

(52) U.S. Cl. ..... 335/78; 335/80; 335/83; 335/85; 335/202; 335/159; 335/162

(58) Field of Search ..... 335/78–86, 106, 335/107, 119, 159, 162, 202, 203, 281

(56) References Cited

U.S. PATENT DOCUMENTS 4,596,972 * 6/1986 Knight et al. ..... 335/281
5,332,985 * 7/1994 Hendel ..... 335/78
5,382,934 * 1/1995 Hendel et al. ..... 335/159

FOREIGN PATENT DOCUMENTS 3428595 2/1986 (DE) .
3513296 * 12/1993 (DE) .
4219933 * 12/1993 (DE) .

* cited by examiner

*Primary Examiner*—Ray Barrera

(57) ABSTRACT

The inventive relay has a base body in the form of a coil body (1), the base body supporting a core (16), a yoke (20), an armature (22) and a contact spring (23) which is connected to the armature. Fixed contact supports (34) and a contact spring connection pin (5) which consist of semi-finished wire with a preferably rectangular or square cross-section are embedded in a flange (12) of the coil body (1). The inventive electromagnetic relay is therefore very simple to produce. There is no wasted material, no punching tools are needed for the contact connection parts and since no particles of plastic are abraded by insertion, there is no risk of this impairing the quality of the relay.

14 Claims, 6 Drawing Sheets

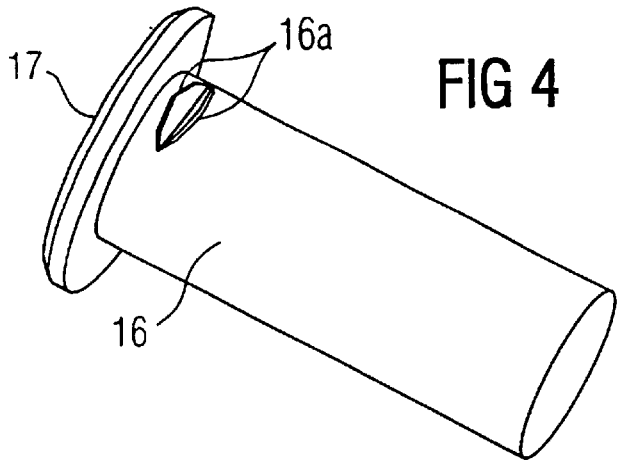
FIG 4
FIG 5
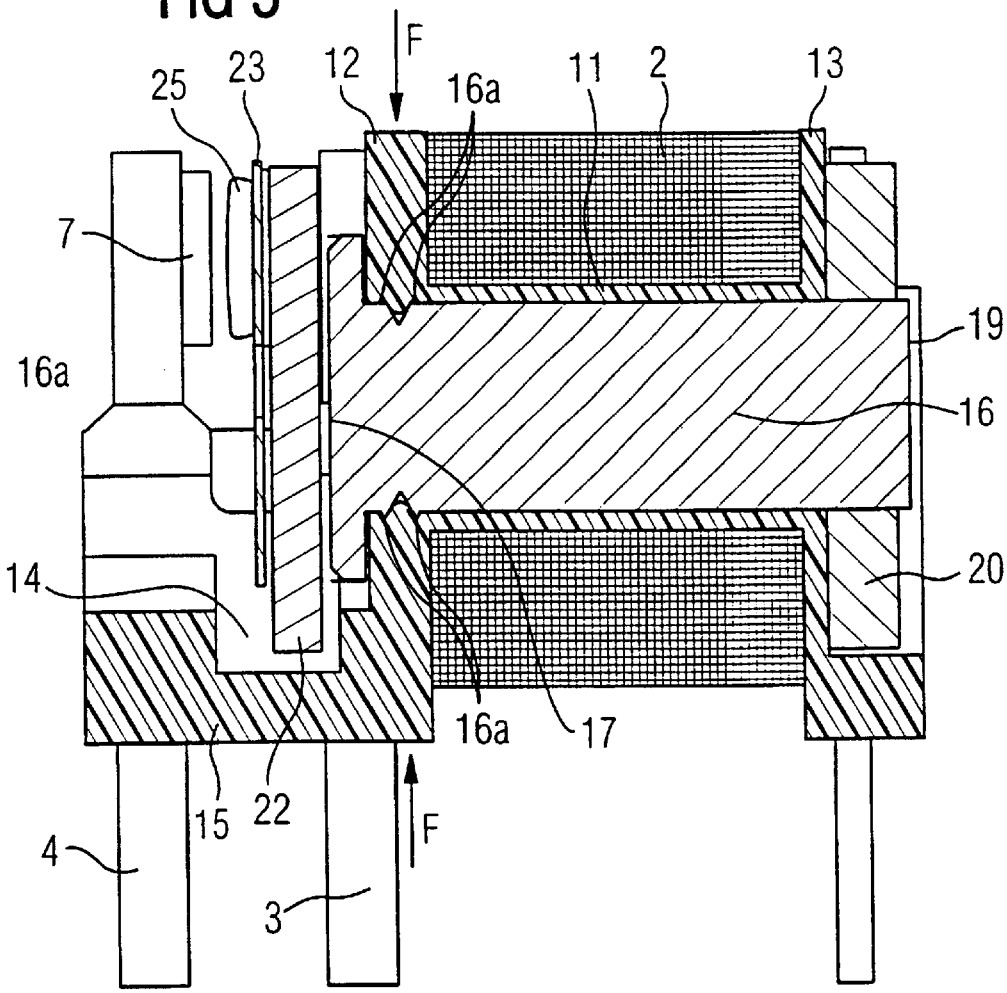

ELECTROMAGNETIC RELAY

BACKGROUND OF THE INVENTION

The invention relates to an electromagnetic relay with the following features:

- a coil body forms a coil tube with two flanges and carries a winding on the coil tube;
- a first of the two flanges forms a switch space with a base side parallel to the coil axis;
- within the coil tube there is arranged an axial core which forms a pole face toward the switch space and is connected to an L-shaped yoke in the region of the second flange;
- with its free end, the yoke forms, in the region of the switch space, a bearing edge, perpendicular to the base side, for a plate-shaped armature which forms a working air gap with the pole face of the core;
- at least one, fixed contact support carrying a first fixed contact is secured in the coil body in the vicinity of the moving end of the armature and
- a contact spring formed from flat strip material is connected to the armature, carries a moving contact at one free end in the region of the moving end of the armature and is connected to a contact spring connecting pin of the relay via a connecting portion.

A relay constructed in this way is known, for example, from U.S. Pat. No. 4,596,972. The contact spring there surrounds the armature mounting in the form of an arc and is fastened to the yoke by its connecting portion, the yoke in turn forming a downwardly shaped connecting pin. With a relay of this type, in which the load current is guided via the yoke, the current path in the relay to the connection is relatively long; the ferromagnetic yoke material also has limited conductivity. This is undesirable for the switching capacity of high currents if the connecting pin with its relatively small cross-section is also produced from the same material. A connecting pin shaped on the yoke also necessitates additional expenditure, if the relay housing is to be sealed.

In the case of similarly constructed relays which are designed for high load currents, it is known to guide the load current from a connecting pin fastened in a base via a flexible copper wire directly to the contact spring and to the contact piece fastened thereon (DE 34 28 595 C2). In this way, the yoke does not have to carry the load current. However, the use of the flexible wire necessitates additional expenditure for material and assembly.

With this known relay, the fixed contact supports and optionally also the contact spring connecting pin are produced as respective punched parts and are assembled by plugging them into preshaped ducts and apertures in the coil body or a base and then fixed by a notching process or inherent pressing. This design has the drawback that the parts do not fit in the plastic part in an interlocking manner for reasons of tolerance or that particles are abraded during assembly owing to overlapping of parts. These particles can subsequently lead to problems in the relay, for example on the contacts, in the armature bearing or in the working air gap. High expenditure then has to be incurred during production, to eliminate the resultant particles by blowing or extraction devices.

It is known with other relays to punch individual parts such as contact supports from sheet metal and to extrusion-coat them either individually or linked in strips in a mould. This method of production has the drawback that the parts have to be inserted into the injection mould; strip production also entails high consumption of material. High expenditure is required in both cases for adapting the injection mould to the punching tools, in order to allow the mould to be sealed well in the region of the punching burrs.

BRIEF SUMMARY OF THE INVENTION

It is an object of the present invention to create a relay of the type mentioned at the outset with a simple design, which can also be produced easily with few parts. In particular, the construction should allow the use of particularly desirable semi-finished materials and waste-free production processes which are particularly economical with materials, so that the relay can be produced particularly economically but still with high quality.

According to the invention, this object is achieved with a relay of the type mentioned at the outset in that the contact spring connecting pin and the at least one fixed contact support consist of drawn or rolled wire and are embedded in the coil body.

The use according to the invention of wire connecting elements for the load circuit connections allows particularly inexpensive production of the relay, which is economical in material. As the semi-finished wire is inserted into the injection mould directly from the supply roll and is embedded there, punching and bending tools are not required. The coil connections used in the normal manner are also preferably extrusion-coated in the mould in the same manner. The wire can be separated either before being extrusion-coated or after being extrusion-coated, directly by the injection moulding tool, without the formation of waste. The sealing of the injection mould is unproblematical owing to the use of drawn or rolled wires with a simple, preferably round or rectangular profile, as punching burrs or the like do not have to be allowed for. As the relay does not have any plugged-in punched parts, no plastic particles which could damage the contact surfaces or pole faces are shaved off during assembly.

In the simplest configuration, the relay has only one fixed contact which interacts with the contact spring as a make or break contact and is accordingly arranged on one or other side of the spring end with the moving contact. Similarly, however, a make-and-break contact can also be produced, in which case a second fixed contact support with a second fixed contact is secured in the same coil body flange opposite the first.

In a preferred embodiment of the invention, the contact spring connecting pin is also embedded in the first coil flange, in other words in the region of the switch space, and the connecting portion of the contact spring is fastened directly on a portion of the connecting pin extending parallel to the bearing edge of the yoke. The armature lies with its bearing end between the yoke end and the connecting pin in this case while the connecting portion of the contact spring is guided past the bearing end of the armature to the connecting pin and is fastened, preferably welded or hard soldered, thereon.

In an advantageous configuration, the contact spring connecting pin, like the fixed contact support, consists of square wire in each case. In this case, the contact springs on the one hand and the fixed contacts on the other hand can be welded or soldered with a large transitional area to the support. The fixed contacts themselves are preferably also separated from a semi-finished contact strip as portions, so no waste is produced here either.

The core arranged in the coil tube preferably possesses a pole plate with a pole face which is enlarged eccentrically toward the armature mounting. Therefore, even with small relay dimensions, on the one hand an adequate insulating distance from the fixed contacts and on the other hand a sufficiently large pole face can be produced. In an advantageous configuration, the core can be embedded in the coil body during production of the coil body, making a subsequent plug-in process unnecessary. In this case, the core can have a round or also a rectangular cross-section. However, it is also possible to plug a round (or rectangular) core into a through-orifice of the coil member at the later stage. In this case, it is advantageous to provide, on the core surface in the vicinity of the pole plate, embossed studs which form an interlocking fit during subsequent relaxation of the thermoplastic core body material and which therefore fix the core pole face and the bearing edge of the yoke reciprocally in position.

In an advantageous configuration of the invention, the contact spring is also fastened on the yoke by a fastening portion surrounding the armature mounting at an angle and a connecting portion folded over the fastening portion is guided to the connecting pin and connected to it. This ensures that a large spring cross-section is available for guiding the load current to the connecting pin in a relay for high load currents.

As a result of the embedding of all load connections in the region of one coil flange, the connections are already guided tightly downwardly through the base of the switch space. Therefore, a cap placed onto the coil body merely has to be sealed along the external contour of the coil flange. The same applies to the opposing second flange, where an injection moulded coil connecting pin is also already embedded tightly. Therefore, there remains only the space beneath the coil winding can easily be closed by a plate and sealed along its edges.

The embodiment will be described in more detail hereinafter by embodiments with reference to the drawings, in which:

BRIEF DESCRIPTION OF THE DRAWINGS

FIG. 4 shows a plug-in core for the relay according to FIG. 2, FIG. 5 is a vertical longitudinal section through the relay from FIG. 1 with a core according to FIG. 4.

DETAILED DESCRIPTION OF THE INVENTION

Figure 1:
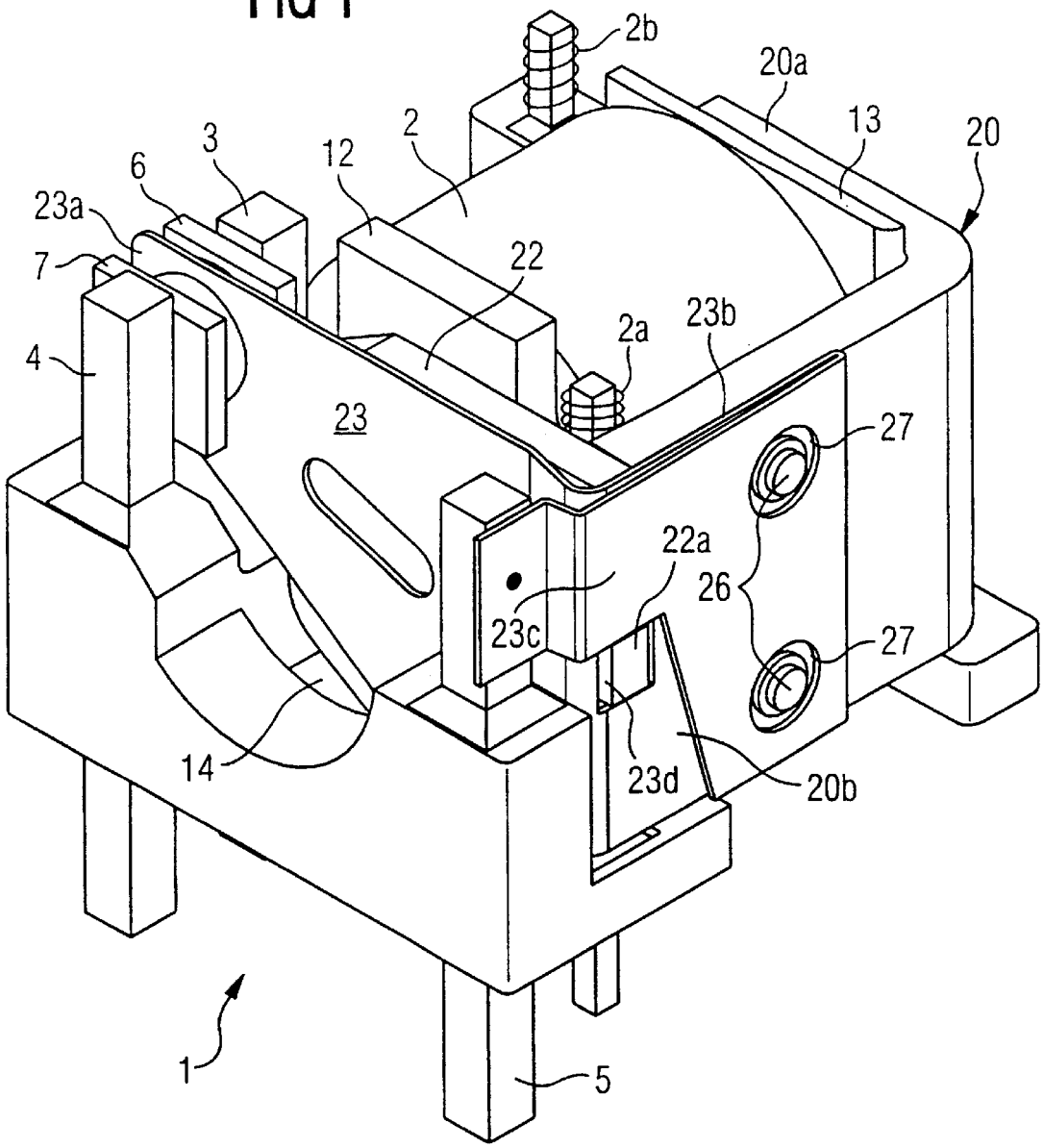
FIG. 1 is a perspective view of a relay designed according to the invention (without housing cap)

The relay shown in FIGS. 1 to 5 possesses, as supporting part, a coil body 1 with a coil tube 11, a first flange 12 and a second flange 13. The first flange 12 forms a projection in which there is formed a switch space 14 which is closed at the bottom by a base 15 and therefore defines the connecting side of the relay. A winding 2 is arranged on the coil tube 11.

Two fixed contact supports 3 and 4 and a contact spring connecting pin 5 are embedded in the projection of the first flange 12 by extrusion coating and are designed as a semi-finished product made of highly conductive material, for example copper, as a square wire. Instead of the illustrated wire with a square cross-section, a wire with a rectangular or round cross-section could also be used. The two fixed contact supports are provided with a respective fixed contact on the mutually facing surfaces, namely a first fixed contact 6 which acts as a make counter contact and with a second fixed contact 7 which acts as a break counter contact. These contacts are cut in each case as contact pieces from a strip of semi-finished contact material and are welded or (preferably) hard soldered on the fixed contact support 3 and 4.

Two further wires preferably with a smaller cross-section are diagonally offset as coil connecting pins 9 and 10 in the second or in the first flange and are embedded in the same manner as the load connections. These coil connecting pins are preferably designed with a square cross-section so that the initial turns at the ends of the winding are better fixed prior to being connected in terms of material. This connection is preferably produced by TIG welding or TIG soldering, during which a flux-free and therefore particle-free connection is produced.

The coil tube 11 contains a round or rectangular soft magnetic core 16 with an integrally shaped pole plate 17 from the contour of which a segment is separated on one side along the line 18. A large pole face is thus obtained, in particular on the side directed toward the armature mounting whereas a sufficiently large insulating distance from the fixed contact support 3 is ensured on the opposite side. The core end 19 opposing the pole plate 17 projects from the coil tube and is connected to one arm 20*a* of an L-shaped yoke 20. The second arm 20*b* of the L-shaped yoke 20 extends laterally parallel to the coil axis and forms a bearing edge 21 for an armature 22 at its end.

Figure 3:
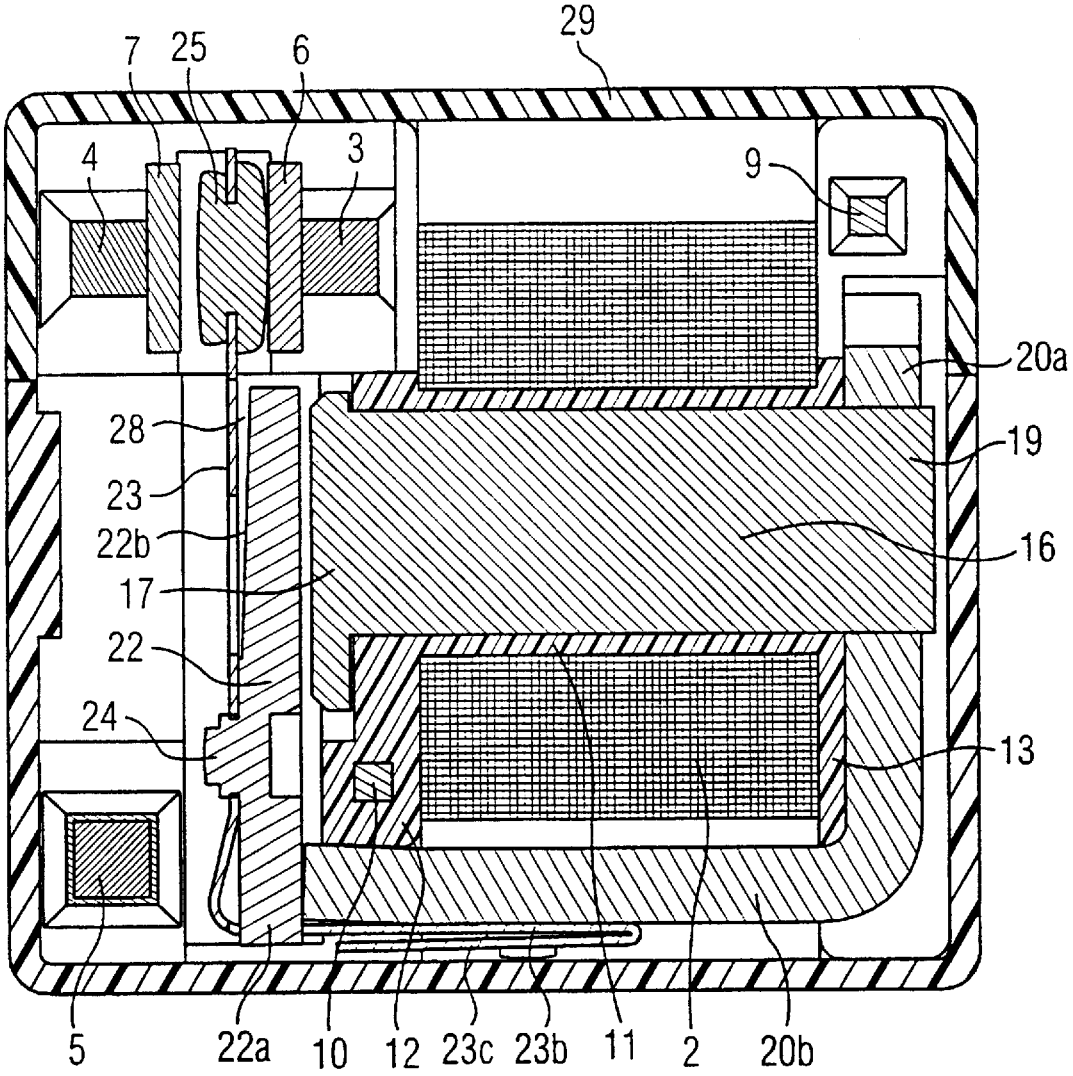
FIG. 3 is a horizontal longitudinal section through the finally assembled relay from FIG. 1.

With the hollowing of the coil body 1, the core 16 can be embedded therein, in other words in the coil tube 11, so that subsequent plugging in is unnecessary (see FIG. 3). In this case, the core end 19 projecting beyond the coil body serves to centre the core in the injection mould.

To prevent armature erosion (over-travel) for the service life of a make contact in the case of an extrusion-coated core, the armature has a free embossment 22*b* in the region below the movable contact spring end, so that an air gap 28 is created between the contact spring 23 and the armature 22. A set bending point is also predetermined by lateral constrictions 22*c*. It allows the over-travel to be increased if the armature is easily kinked by the force of the coil axis.

However, it is also possible to plug the core into the coil tube at a later stage according to FIG. 2. In this case, it is advantageous to emboss studs 16*a* on the periphery of the cylindrical (or rectangular) core in the vicinity of the pole plate 17, as shown in FIGS. 4 and 5. These projecting studs 16*a* are oversized in the region of the coil flange 12 in the assembled state and produce an interlocking fit during subsequent relaxation of the thermoplastic material; the core pole face is therefore fixed in position on the pole plate 17 and the bearing edge 21 of the yoke in the coil body and therefore in relation to the fixed contact supports embedded in the coil body. Tolerances in the two parts are eliminated and an optimum force of magnetic attraction achieved for the armature since the core and the yoke are connected, for example by a notched connection, in the region of the coil flange 13 in such a way that the pole face of the pole plate 17 and the yoke bearing edge 21 are aligned with one another. Tolerance compensation and over-travel adjustment are effected in such a way that the notched yoke/core unit is inserted axially in the coil tube until the over-travel of the armature attains its set value. The reciprocal arrangement of the optimally aligned faces in the working and armature mounting air gap do not change; only the magnet system is adapted to the position of the contact assembly. Relaxation of the thermoplastic coil body material can be accelerated by the additional effect of forces F on opposing sides of the coil flange 12 (see FIG. 5) perpendicularly to the coil axis, so that the fixing of the core in the region of the flange 12 is ensured after adjustment.

A contact spring 23 is connected to the armature 22 by a riveted joint 24 carrying, at its end 23*a* projecting beyond the armature, a movable contact 25 which interacts with the two fixed contacts 6 and 7 as a central contact. As in the embodiment illustrated, it can be designed as a riveted contact or can also be formed by two contact pieces which are welded or soldered against one another and separated by a strip of high grade metal. In the region of the armature mounting, the contact spring 23 possesses a fastening portion 23*b* which is bent in the form of a curl or a loop over the mounted end of the armature and is fastened flat on the yoke arm 20*b* with riveted studs 26 (or welded spots). This fastening portion 23*b* of the contact spring produces the armature restoring force owing to its bias. The contact spring 23 also possesses a connecting portion 23*c* which extends beyond the fastening portion 23*b*, is folded round 180° over the fastening portion 23*b* and is fastened by its end on the connecting pin 5 by welding or hard soldering. This connecting portion of the spring is used only for carrying current and does not affect the restoring force of the armature. It is provided with apertures 27 in the region of the rivet studs 26 (or welded spot), so it is not co-riveted. To prevent impacts, the armature 22 possesses a securing nose 22*a* which penetrates into a rectangular hole 23*d* punched in the fastening portion 23*b* and secures the armature axially relative to the coil.

Figure 2:
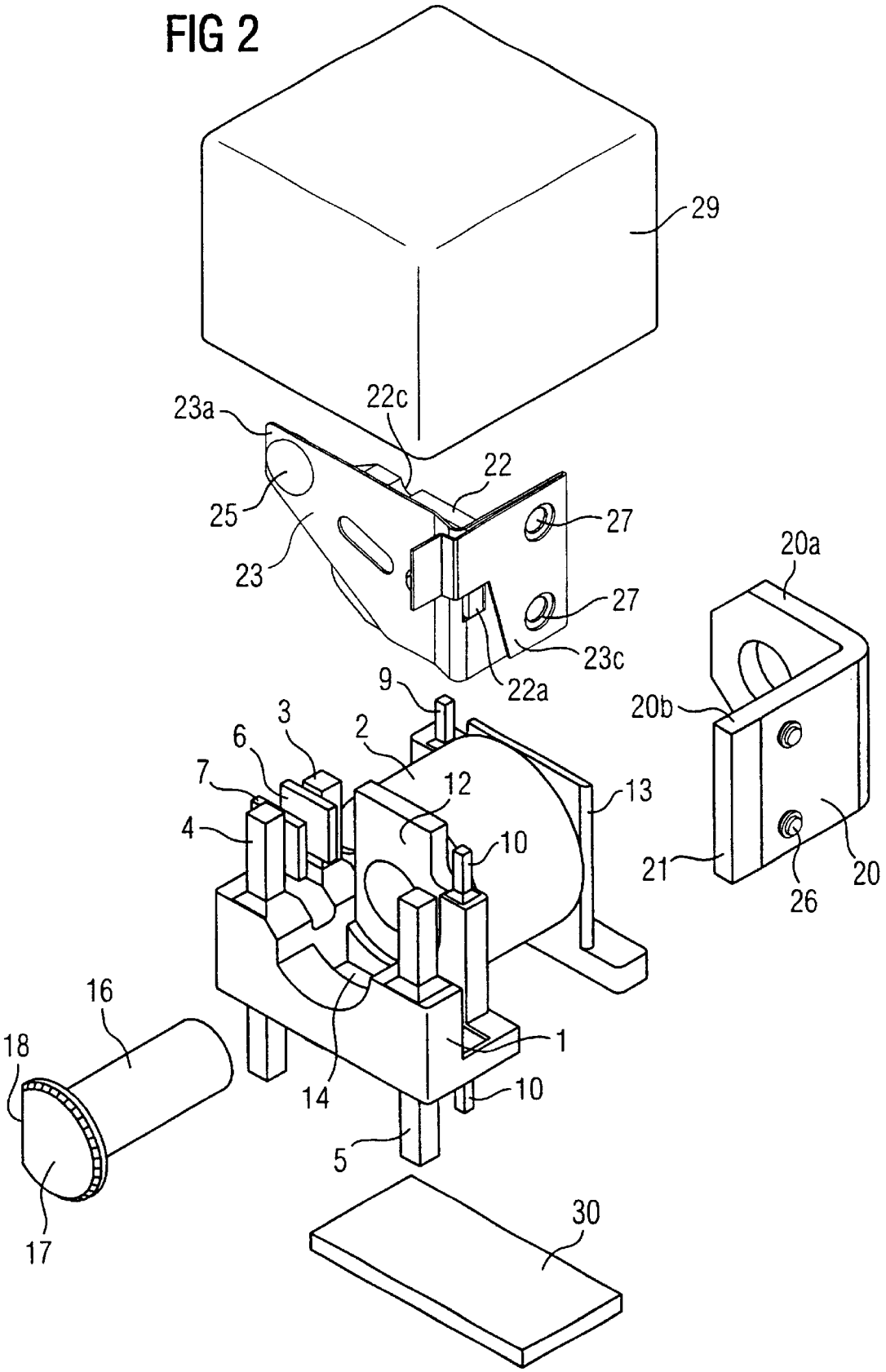
FIG. 2 shows the relay from FIG. 1 in the partially assembled state (with housing)
Figure 6:
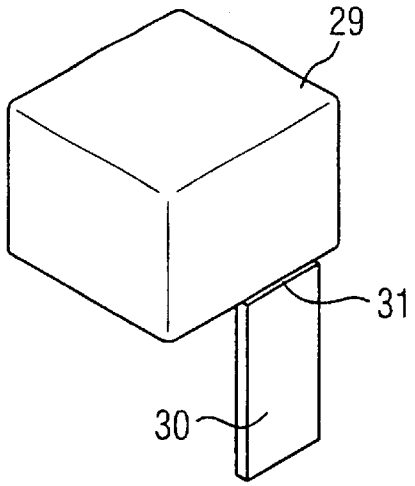
FIG. 6 shows a modified housing cap with a flexibly moulded base plate.

The open printed-circuit board relay according to FIG. 1 described hitherto can be provided with a protective cap 29 according to FIG. 2. A base plate 30 which covers the coil winding space at the bottom can additionally be inserted in the region of the base between the two flanges 12 and 13. The gaps between the cap 29, the base plate 30 and the coil body 1 can then be sealed by a casting compound. The base plate 30 covering only the coil space does not cause abrasion of particles as the wire-shaped connections, namely the fixed contact supports 3 and 4, the contact spring connecting pin 5 and the coil connecting pins 9 and 10 are embedded in the flanges and do not require apertures in the base plate. The base plate 30 can also be connected integrally to the cap 29 by a film hinge 31 according to FIG. 6. In this case, it is pivoted over the coil space after assembly of the cap and sealed.

Figure 7:
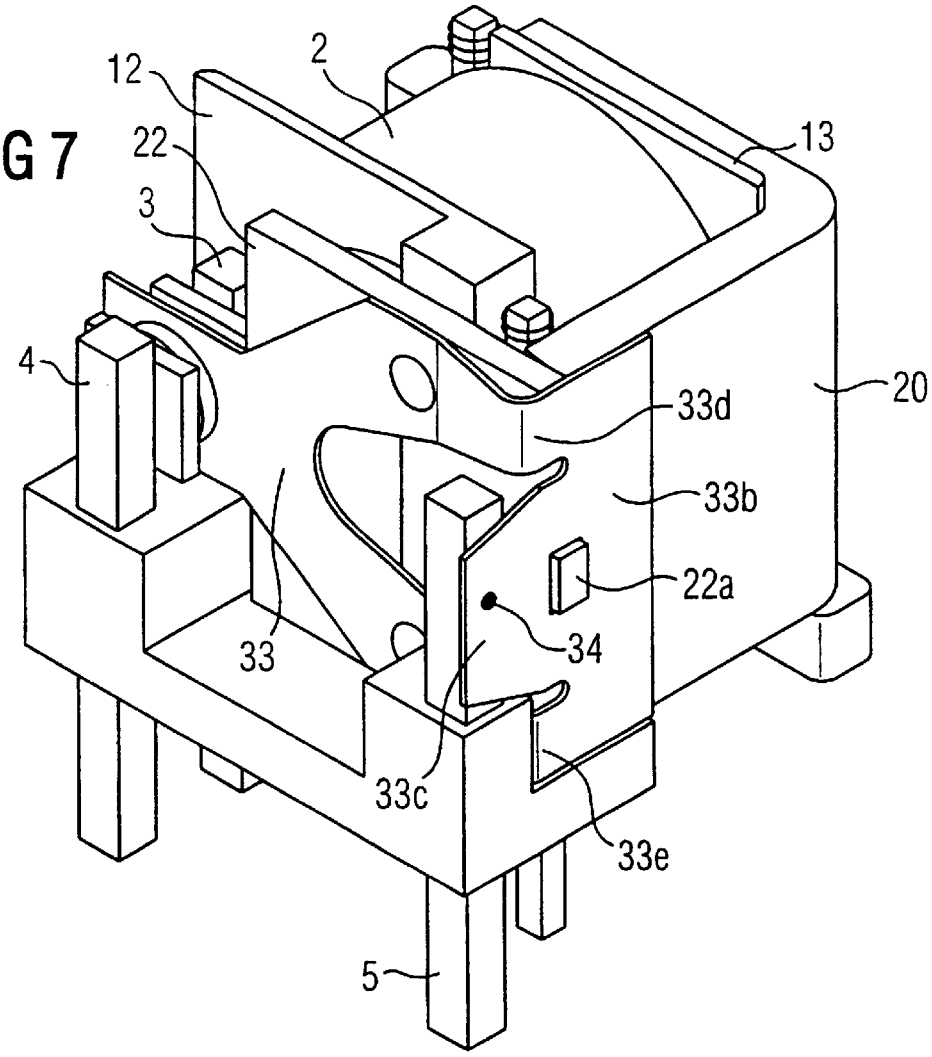
FIG. 7 shows a relay in a view corresponding to FIG. 1 with a modified contact spring.

FIG. 7 shows a relay similar to that in FIG. 1 but with a modified contact spring 33. In comparison to the previously described contact spring 23, with which a large conductor cross-section is provided for high currents by means of the folded connecting portion 23*c*, the simplified form of the contact spring 33 can be used for lower current loads. In this case, the contact spring 33 possesses a bearing portion 3*b* which is bent over the armature mounting while a connecting portion 33*c* also used for fastening purposes is cut from the central region of the spring and is guided parallel to the yoke surface directly to the contact spring connecting pin 5. The welded or soldered spot 34 is used both for the fastening and for the electrical connection of the contact spring. Individual fastening on the yoke is unnecessary. The remaining spring arms 33*d* and 33*e* produce the restoring force of the armature contact spring unit. Otherwise, this relay according to FIG. 7 is constructed in exactly the same way as the previously described relay.

Figure 8:
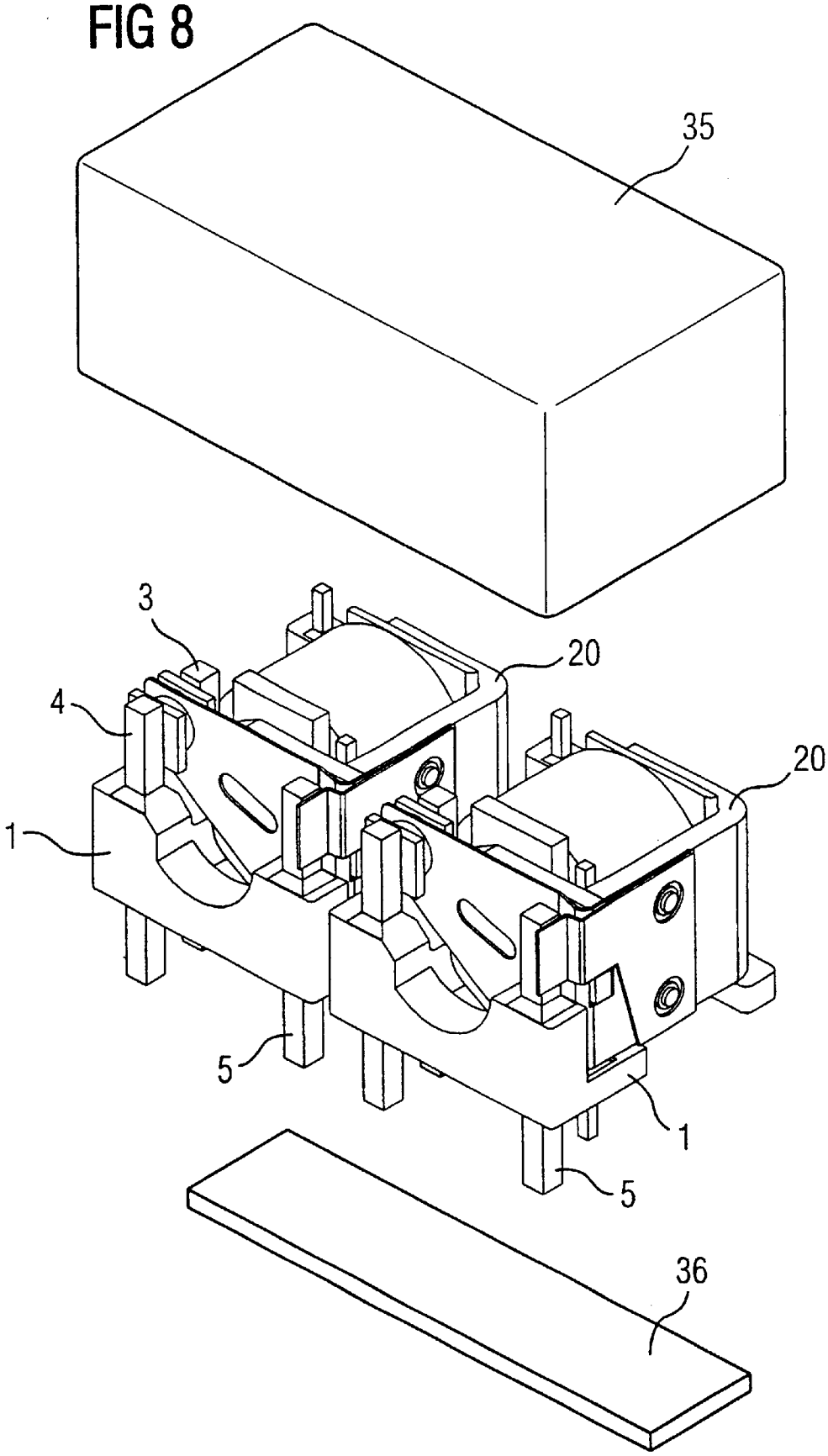
FIG. 8 shows the arrangement of two relays according to FIG. 1 with a housing for forming a double relay.

The relay can also be provided as a double relay with a common housing. As shown in FIG. 8, in this case, two individual relays with a respective coil body 1 according to FIG. 1 are arranged side by side with their coil axes in parallel and are provided with a common cap 35 and a common base plate 36. The gaps between the cap and the base plate on the one hand and the coil bodies 1 on the other hand are sealed with casting compound in the conventional manner. Double relays of this type with two changeover contacts are preferably used as reversing relay for d.c. motors.

What is claimed is:

1. Electromagnetic relay with the following features:

a coil body (1) forms a coil tube (11) with two flanges (12, 13) and carries a winding (2) on the coil tube (11);

a first of the two flanges (12) forms a switch space (14) with a base side (15) parallel to the coil axis;

within the coil tube (11) there is arranged an axial core (16) which forms a pole face toward the switch space (14) arid is connected to an L-shaped yoke (20) in the region of the second flange (13);

with its free end, the yoke (20) forms, in the region of the switch space, a bearing edge (21), perpendicular to the base side (15), for a plate-shaped armature (22) which forms a working air gap with the pole face of the core (16);

at least one fixed contact support (3) carrying a first fixed contact is secured in the coil body in the vicinity of the moving end of the armature; and a contact spring (23; 33) formed from flat strip material is connected to the armature (22), carries a moving contact (25) at one free end (23*a*) in the region of the moving end of the armature and is connected to a contact spring connecting pin (5) of the relay via a connecting portion (23*c*; 33*c*), characterised in that the contact spring connecting pin (5) and the at least one fixed contact support (3, 4) consist of drawn or rolled wire and are embedded in the coil body (1).

2. Relay according to claim 1, characterised in that a second fixed contact support (4) with a second fixed contact (7) is embedded in the first coil flange (12) in such a way that the moving contact (25) can be switched between the two fixed contacts (6, 7).

3. Relay according to claim 2, characterised in that the fixed contacts (6, 7) in the form of portions of contact strip are welded or hard soldered onto the contact supports (3, 4).

4. Relay according to claim 1, characterised in that the contact spring connecting pin (5) is embedded in the first coil flange (12) and in that the connecting portion (23*c*; 33*c*) of the contact spring (23; 33) is fastened directly on a portion of the connecting pin (5) extending parallel to the bearing edge (21).

5. Relay according to claim 1, characterised in that the contact spring connecting pin (5) and the fixed contact support (3, 4) consist of square wire or round wire.

6. Relay according to claim 1, characterised in that the core (16) forms a pole plate (17) which is configured eccentrically toward the armature.

7. Relay according to claim 1, characterised in that the core (16) is embedded in the coil body (1).

8. Relay according to claim 1, characterised in that the core (16) is plugged into the coil tube and is fixed by means of embossed studs (16*a*).

9. Relay according to claim 1, characterised in that the contact spring (23) is fastened on the yoke (20) by a fastening portion (23*b*) and in that a connecting portion (22*c*) folded over the fastening portion (22*b*) is guided to the connecting pin (5).

10. Relay according to claim 9, characterised in that the fastening portion (23*b*) is fastened on the yoke (20) by at least one rivet (26) or welded spot and in that the connecting portion (23*c*) has a recess (27) in the region of each rivet (26) or welded spot.

11. Relay according to claim 1, characterised in that the contact spring (33) rests on the yoke (20) by a bearing portion (33*b*) and is connected to the connecting pin (5) via a connecting portion (33*c*) which is cut away in the region of the armature mounting.

12. Relay according to claim 1, characterised in that it comprises a housing cap (29) surrounding the coil flanges (12, 13) and in that the space below the winding is covered by a base plate (30) arranged between the two flanges (12, 13) and is sealed by a casting compound.

13. Relay according to claim 12, characterised in that the base plate (30) is connected integrally to the housing cap (29) by a film hinge (31).

14. Arrangement of at least two relays according to claim 1, characterised in that the relays are arranged with their coil axes in parallel side by side in a common cap (35), the space beneath the windings being covered by a common base plate (36).

* * * * *